US005266171A

United States Patent [19]

Hermeling

[11] Patent Number: 5,266,171

[45] Date of Patent: Nov. 30, 1993

[54] PREPARATION OF α-HYDROXYMETHAL ACETALS

[75] Inventor: Dieter Hermeling, Neustadt, Fed. Rep. of Germany

[73] Assignee: BASF Aktiengesellschaft, Ludwigshafen, Fed. Rep. of Germany

[21] Appl. No.: 705,786

[22] Filed: May 28, 1991

[30] Foreign Application Priority Data

May 31, 1990 [DE] Fed. Rep. of Germany ..... 4017575
May 31, 1990 [DE] Fed. Rep. of Germany ..... 4017576

[51] Int. Cl.[5] ..... C25B 3/00
[52] U.S. Cl. ..... 204/59 R; 204/78; 204/79
[58] Field of Search ..... 204/59 R, 78, 79

[56] References Cited

U.S. PATENT DOCUMENTS 4,284,825 8/1981 Degner ..... 204/59 R
4,318,783 3/1982 Buhmann et al. ..... 204/59 R
5.078,838 1/1992 Hermeling et al. ..... 204/78

FOREIGN PATENT DOCUMENTS 57-188684 10/1982 Japan .
57-188686 10/1982 Japan .

OTHER PUBLICATIONS

Tetrahedron Letters 25 (1984) 691-694 and 30 (1989) 371-374.
J. Org. Chem. 51 (1986) 130-135.
J. Chem. Soc., Perkin I (1986) 73-77.
Zeitschrift Für Naturforschung, Part B, vol. 31B,. Nr. 2 1976, pp. 175-177.
Tetrahedron, vol. 47, Nr. 4/5, Jan. 28, 1991, pp. 895-905.

*Primary Examiner*—John Niebling
*Assistant Examiner*—Brian M. Bolam
*Attorney, Agent, or Firm*—John H. Shurtleff

[57] ABSTRACT

A process for preparing an α-hydroxymethyl acetal by the electrochemical oxidation of a carbonyl compound, e.g. an aliphatic or aromatic aldehyde or ketone, with a $C_1$-$C_8$-alkanol under non-alkaline conditions and in the presence of an auxiliary electrolyte containing from 0 to 5% and preferably 0.5 to 3% by weight of water.

12 Claims, No Drawings

PREPARATION OF α-HYDROXYMETHAL ACETALS

The present invention relates to a process for preparing α-hydroxymethyl acetals by electrochemical oxidation of carbonyl compounds with alkanols in the presence of an auxiliary electrolyte and in the presence or absence of water.

J. Chem. Soc. Perkin I (1986) 73–77 discloses the electrochemical oxidation of aliphatic aldehydes and ketones under basic conditions to give α-hydroxy acetals. Oxidation under neutral conditions gives only low yields (JP-A 57/188 684).

JP-A 57/188 686 describes the α-hydroxylation of aliphatic aldehydes and ketones in neutral solution in the presence of relatively large amounts of water directly to the α-hydroxy aldehydes and α-hydroxy ketones. However, many α-hydroxy compounds can be obtained by these methods only with difficulty, if at all.

Tetrahedron Letters 25 (1984) 691–694 and J. Org. Chem. 51 (1986) 130–135 disclose the preparation of α-hydroxymethyl aryl acetals under basic conditions in multistage reactions with long reaction times from starting compounds which are difficult to obtain.

The electrochemical oxidation of aliphatic aldehydes and ketones with "I+" generated at the anode in the presence of an alcohol under basic conditions to give the corresponding α-hydroxy acetals is described in J. Chem. Soc. Perk. I (1986) 73–77. Oxidation under neutral conditions provides only low yields (JP-A 57/188 684). The formation of α-hydroxy compounds from aromatic ketones is not described. On the contrary, Tetrahedron Letters 30 (1989) 371–374 discloses that, under similar conditions, i.e. in alcoholic solution, but with iodine/lithium perchlorate as auxiliary electrolyte, aryl ketones either are not oxidized at all or react only to give the acetals. In the presence of orthoesters under conditions which are otherwise unchanged there is no 2-hydroxylation but 1,2-rearrangement of the aryl radical to give 2-alkyl-2-arylacetic esters.

It is an object of the present invention to remedy the abovementioned disadvantages.

We have found that this object is achieved by a novel and improved process for preparing α-hydroxymethyl acetals of the formula I

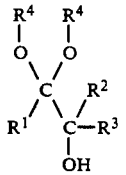

(I)

where $R^1$, $R^2$ and $R^3$ are each, independently of one another, hydrogen, $C_1$–$C_{20}$-alkyl, $C_2$–$C_{20}$-alkenyl, $C_2$–$C_{20}$alkynyl, $C_3$–$C_{12}$-cycloalkyl, $C_4$–$C_{20}$-cycloalkylalkyl, $C_1$–$C_{20}$-hydroxyalkyl, aryl or $C_7$–$C_{20}$-arylalkyl which is unsubstituted or substituted by $C_1$–$C_8$-alkyl, $C_1$–$C_8$-alkoxy, halogen, $C_1$–$C_4$-haloalkyl, $C_1$–$C_4$-haloalkoxy, phenyl, phenoxy, halophenyl, halophenoxy, carboxyl, $C_2$–$C_8$-alkoxycarbonyl or cyano, or $R^1$ and $R^2$ or $R^2$ and $R^3$ together are $(CH_2)_n$ or $(CH{=}CH)_m$ which is unsubstituted or mono- or disubstituted by $C_1$–$C_8$-alkyl, $C_1$–$C_8$-alkoxy and/or halogen and in which n is 1 to 10 and m is 1 to 3 and $R^4$ is $C_1$–$C_8$-alkyl, which comprises electrochemical oxidation of a carbonyl compound of the formula II

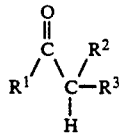

(II)

where $R^1$, $R^2$ and $R^3$ have the abovementioned meanings, with an alkanol of the formula III $$R^4\text{—OH} \qquad \text{(III)}$$

where $R^4$ has the abovementioned meaning,, in the presence of an auxiliary electrolyte and from 0 to 5% by weight of water. More narrowly, the improvement of the invention is achieved by a process for preparing α-hydroxymethyl aryl acetals of the formula I'

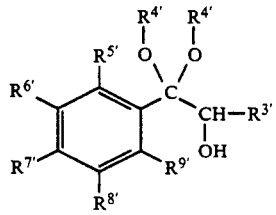

(I')

where $R^{3'}$ is hydrogen, $C_1$–$C_{20}$-alkyl, $C_2$–$C_{20}$-alkenyl, $C_2$–$C_{20}$-alkynyl, $C_2$–$C_{20}$-alkoxyalkyl, $C_4$–$C_{20}$-alkenyloxyalkyl, $C_3$–$C_{12}$-cycloalkyl or $C_4$–$C_{20}$-cycloalkylalkyl, $R^{4'}$ is $C_1$–$C_8$-alkyl and $R^{5'}$, $R^{6'}$, $R^{7'}$, $R^{8'}$ and $R^{9'}$ are each, independently of one another, hydrogen, $C_1$–$C_8$-alkyl, $C_1$-$C_8$-alkoxy, $C_2$-$C_8$-alkenyl, $C_3$–$C_8$-alkenyloxy, $C_2$–$C_8$-alkynyl, $C_3$–$C_8$-alkynyloxy, halogen, cyano, phenyl, phenoxy, halophenyl, halophenoxy, carboxyl, $C_2$–$C_8$-alkoxycarbonyl, $C_3$–$C_8$-alkenyloxycarbonyl, $C_3$–$C_8$-alkynyloxycarbonyl, or $R^{5'}$ and $R^{6'}$ or $R^{6'}$ and $R^{7'}$ together are $(CH_2)_{n'}$ or $(CH{=}CH)_{m'}$ which is unsubstituted or mono- or disubstituted by $C_1$–$C_8$-alkyl, $C_1$–$C_8$-alkoxy and/or halogen and in which n' is 1 to 10 and m' is 1 to 3, which comprises electrochemical oxidation of an aryl methyl ketone of the formula II'

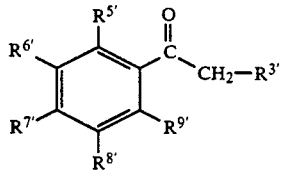

(II')

where $R^{3'}$ has the abovementioned meanings, with an alkanol of the formula III'

$$R^{4'}\text{—OH} \qquad \text{(III')}$$

where $R^{4'}$ has the abovementioned meanings, in the presence of an auxiliary electrolyte and from 0 to 5% by weight of water.

While the electrochemical oxidation can be carried out in the absence of water, especially improved yields are obtained by adding to the electrolyte from 0.1 to 0.5% and preferably 0.5 to 3% by weight of water.

Suitable in principle as starting compounds for preparing the α-hydroxymethyl acetals I and aryl methyl ketones I' according to the invention are all aldehydes and ketones of the formulae II and II' which carry substituents which are inert under the electrolysis conditions.

Suitable meanings for $R^1$ to $R^4$, $R^{3'}$ to $R^{9'}$ and n, n', m and m' in the formulae I to III and I' to III' are, independently of one another, the following:

$R^1$, $R^2$, $R^3$ hydrogen, unbranched or branched $C_1$–$C_{20}$-alkyl, preferably unbranched or branched $C_1$–$C_{12}$-alkyl such as methyl, ethyl, n-propyl, iso-propyl, n-butyl, iso-butyl, sec-butyl, tert-butyl, n-pentyl, iso-pentyl, sec-pentyl, tert-pentyl, neo-pentyl, 1,2-dimethylpropyl, n-hexyl, iso-hexyl, sec-hexyl, n-heptyl, iso-heptyl, n-octyl, iso-octyl, n-nonyl, iso-nonyl, n-decyl, iso-decyl, n-undecyl, iso-undecyl, n-dodecyl and iso-dodecyl, unbranched or branched $C_2$–$C_{20}$-alkenyl, preferably unbranched or branched $C_2$–$C_8$-alkenyl such as allyl, 2-butenyl, 1-methyl-2-propenyl, 4-butenyl, 2-pentenyl and 2,2-dimethylpentenyl, unbranched or branched $C_2$–$C_{20}$-alkynyl, preferably unbranched or branched $C_2$–$C_8$-alkynyl such as propynyl, 1,1-dimethyl-2-propynyl, 1-methyl-2-propynyl, 1-butynyl, 2-butynyl and 4,4-dimethyl-2-butynyl, $C_3$–$C_{12}$-cycloalkyl, preferably $C_3$–$C_8$-cycloalkyl such as cyclopropyl, cyclobutyl, cyclopentyl, cyclohexyl, cycloheptyl and cyclooctyl, $C_4$–$C_{20}$-cycloalkylalkyl, preferably $C_4$–$C_8$-cycloalkylalkyl such as cyclopentylmethyl, 2-cyclopentylethyl, 1-cyclopentylethyl, cyclohexylmethyl, 1-cyclohexylethyl and 2-cyclohexylethyl, unbranched or branched $C_1$–$C_{20}$-hydroxyalkyl, preferably unbranched or branched $C_1$–$C_8$-hydroxyalkyl such as hydroxymethyl, 1-hydroxyethyl, 2-hydroxyethyl, 1-hydroxypropyl, 2-hydroxypropyl and 3-hydroxypropyl, aryl such as phenyl, 1-naphthyl and 2-naphthyl, preferably phenyl, aryl which is mono- to trisubstituted by $C_1$–$C_8$-alkyl, preferably phenyl which is mono- to trisubstituted by $C_1$–$C_4$-alkyl, such as 2-methylphenyl, 4-methylphenyl, 2-ethylphenyl, 4-ethylphenyl, 3-methylphenyl, 2,4-dimethylphenyl, 3,4-dimethylphenyl and 3,4,5-trimethylphenyl, aryl which is mono- to trisubstituted by $C_1$–$C_8$-alkoxy, preferably phenyl which is mono- to trisubstituted by $C_1$–$C_4$-alkoxy, such as 2-methoxyphenyl, 2-ethoxyphenyl, 3-methoxyphenyl, 4-methoxyphenyl, 3-ethoxyphenyl, 4-ethoxyphenyl, 3,4-dimethoxyphenyl and 3,4,5-trimethoxyphenyl, aryl which is mono- to trisubstituted by $C_1$–$C_4$-haloalkyl, preferably phenyl which is mono- to trisubstituted by $C_1$–$C_2$-fluoro- and chloroalkyl, particularly preferably phenyl which is mono- to trisubstituted by trifluoromethyl and trichloromethyl, such as 4-trifluoromethylphenyl and 4-trichloromethylphenyl, aryl which is mono- to trisubstituted by $C_1$–$C_4$-haloalkoxy, preferably phenyl which is mono- to trisubstituted by $C_1$–$C_2$-fluoro- and chloroalkoxy, particularly preferably phenyl which is mono- to trisubstituted by trifluoromethoxy and trichloromethoxy, such as trifluoromethoxyphenyl, aryl which is mono- to trisubstituted by halogen, preferably phenyl which is mono- to trisubstituted by fluorine or chlorine, such as 4-chlorophenyl, 3,4-dichlorophenyl, 4-bromophenyl, 4-fluorophenyl and 4-fluoro-3-chlorophenyl, aryl which is mono- to trisubstituted by halophenyl, preferably phenyl which is mono- to trisubstituted by fluoro- and/or chlorophenyl, such as (4-chlorophenyl)phenyl, aryl which is mono- to trisubstituted by halophenoxy, preferably phenyl which is mono- to trisubstituted by fluoro- and/or chlorophenoxy, such as (4-fluorophenoxy)phenyl, aryl which is mono- to trisubstituted by carboxyl, preferably phenyl which is mono- to trisubstituted by carboxyl, such as 2-carboxyphenyl, 3-carboxyphenyl and 4-carboxyphenyl, aryl which is mono- to trisubstituted by $C_2$–$C_8$-alkoxycarbonyl, preferably phenyl which is mono- to trisubstituted by $C_2$–$C_4$-alkoxycarbonyl, such as 4-methoxycarbonylphenyl, 4-ethoxycarbonylphenyl, 2-methoxycarbonylphenyl, 2-ethoxycarbonylphenyl and 3-methoxycarbonylphenyl, aryl which is mono- to trisubstituted by cyano, preferably phenyl which is mono- to trisubstituted by cyano, such as 2-cyanophenyl, 3-cyanophenyl and 4-cyanophenyl, $C_7$–$C_{20}$-arylalkyl, preferably $C_7$–$C_{12}$-arylalkyl such as benzyl, phenylethyl, phenylpropyl and phenylisopropyl, $C_7$–$C_{20}$-arylalkyl which is mono- to trisubstituted in the aryl moiety by halogen, preferably $C_7$–$C_{10}$-phenylalkyl which is mono- to trisubstituted in the phenyl moiety by fluorine or chlorine, such as 4-fluorobenzyl, 4-chlorobenzyl, 2,4-dichlorobenzyl and 3,4-dichlorobenzyl, $C_7$–$C_{20}$-arylalkyl which is mono- to trisubstituted in the aryl moiety by $C_1$14 $C_8$-alkyl, preferably $C_7$–$C_{10}$-phenylalkyl which is mono- to trisubstituted in the phenyl moiety by $C_1$–$C_4$-alkyl, particularly preferably $C_7$–$C_{10}$-phenylalkyl which is mono- to trisubstituted in the phenyl moiety by $C_1$–$C_2$-alkyl, such as 4-methylbenzyl, 4-ethylbenzyl and 4-methylphenethyl, $C_7$–$C_{20}$-arylalkyl which is mono- to trisubstituted in the aryl moiety by $C_1$–$C_8$-alkoxy, preferably $C_7$–$C_{10}$-phenylalkyl which is mono- to trisubstituted in the phenyl moiety by $C_1$–$C_4$-alkoxy, particularly preferably $C_7$–$C_{10}$-phenylalkyl which is mono- to trisubstituted in the phenyl moiety by $C_1$–$C_2$-alkoxy, such as 4-methoxybenzyl, 4-ethoxybenzyl and 4-methoxyphenethyl, $C_7$–$C_{20}$-arylalkyl which is mono- to trisubstituted in the aryl moiety by $C_1$–$C_4$-haloalkyl, preferably $C_7$–$C_{10}$-phenylalkyl which is mono- to trisubstituted in the phenyl moiety by $C_1$–$C_2$-fluoro- and chloroalkyl, particularly preferably $C_7$–$C_{10}$-phenylalkyl which is mono- to trisubstituted in the phenyl moiety by trifluoromethyl and trichloromethyl, such as 4-trifluoromethylbenzyl and 4-trichloromethylbenzyl, $C_7$–$C_{20}$-arylalkyl which is mono- to trisubstituted in the aryl moiety by $C_1$–$C_4$-haloalkoxy, preferably $C_7$–$C_{10}$-phenylalkyl which is mono- to trisubstituted in the phenyl moiety by $C_7$–$C_2$-haloalkoxy, particularly preferably $C_7$–$C_{10}$-phenylalkyl which is mono- to trisubstituted by trifluoromethoxy and trichloromethoxy, such as 4-trifluoromethoxybenzyl and 4-trichloromethoxybenzyl, $C_7$–$C_{20}$-arylalkyl which is mono- to trisubstituted by halophenyl, preferably $C_7$–$C_{12}$-phenylalkyl which is mono- to trisubstituted by fluoro- and/or chlorophenyl, such as 4-chlorophenethyl and 4-fluorophenethyl, $C_7$–$C_{20}$-arylalkyl which is mono- to trisubstituted by halophenoxy, preferably $C_7$–$C_{12}$-phenylalkyl which is mono- to trisubstituted by fluoro- and/or chlorophenoxy, such as 2-chlorophenoxymethyl and 4-chlorophenoxymethyl, $C_7$–$C_{20}$-arylalkyl which is mono- to trisubstituted by carboxyl, preferably $C_7$–$C_{12}$-phenylalkyl which is mono- to trisubstituted by carboxyl, such as 4-carboxybenzyl, 4-carboxyphenethyl, 2-carboxybenzyl and 2-carboxyphenethyl, $C_7$–$C_{20}$-arylalkyl which is mono- to trisubstituted by $C_2$–$C_8$-alkoxycarbonyl, preferably $C_7$–$C_{12}$-phenylalkyl which is mono- to trisubstituted by $C_2$–$C_4$-alkoxycarbonyl, such as 4-methoxycarbonylbenzyl, 2-methoxycarbonylbenzyl, 4-ethoxycarbonylbenzyl and 2-ethoxycarbonylbenzyl, $C_7$–$C_{20}$-arylalkyl which is mono- to trisubstituted by cyano, preferably $C_7$–$C_{12}$-phenylalkyl which is mono- to trisubstituted by cyano, such as 2-cyanobenzyl, 4-cyanobenzyl, 2-cyanophenethyl and 4-cyanophenethyl, phenyl which is substituted by one, two or three phenyl groups, such as 2-phenylphenyl, 3-phenylphenyl, 4-phenylphenyl and 3,4-diphenylphenyl, phenyl which is substituted by one, two or three phenoxy groups, such as 4-phenoxyphenyl and 2-phenoxyphenyl, phenyl which is di- or trisubstituted by halogen and $C_1$–$C_4$-alkyl, such as 2-methyl-4-chlorophenyl and 3-methyl-4-fluorophenyl, phenyl which is di- or trisubstituted by halogen and $C_1$–$C_4$-alkoxy, such as 3-chloro-4-methoxyphenyl, phenyl which is di- or trisubstituted by halogen and $C_1$–$C_4$-haloalkyl, such as 2-chloro-4-trifluoromethylphenyl, phenyl which is di- or trisubstituted by halogen and phenoxy, such as 3-chloro-4-phenoxyphenyl, phenyl which is di- or trisubstituted by $C_1$–$C_4$-alkyl and $C_1$–$C_4$-alkoxy, such as 2-methyl-4-methoxyphenyl, phenyl which is di- or trisubstituted by $C_1$–$C_4$-alkyl and $C_1$–$C_4$-haloalkyl, such as 3-methyl-4-trichloromethylphenyl, phenyl which is di- or trisubstituted by $C_1$–$C_4$-alkyl and phenoxy, such as 2-methyl-4-phenoxyphenyl, phenyl which is di- or trisubstituted by $C_1$–$C_4$-alkoxy and $C_1$–$C_4$-haloalkyl, such as 3-trifluoromethyl-4-methoxyphenyl, phenyl which is di- or trisubstituted by $C_1$–$C_4$-alkoxy and phenoxy, such as 3-methoxy-4-phenoxyphenyl, phenyl which is di- or trisubstituted by $C_1$–$C_4$-haloalkyl and phenoxy, such as 3-trifluoromethyl-4-phenoxyphenyl, phenyl which is trisubstituted by halogen, $C_1$–$C_4$-alkyl and $C_1$–$C_4$-alkoxy, such as 2-chloro-3-tert-butyl-4-methoxyphenyl, phenyl which is trisubstituted by halogen, $C_1$–$C_4$-alkyl and $C_1$–$C_4$-haloalkyl, such as 2-methyl-3-chloro-4-trifluoromethylphenyl, phenyl which is trisubstituted by halogen, $C_1$–$C_4$-alkyl and phenoxy, such as 4-chloro-2-ethyl-3-phenoxyphenyl, phenyl which is trisubstituted by halogen, $C_1$–$C_4$-alkoxy and $C_1$–$C_4$-haloalkyl, such as 3-chloro-4-methoxy-3-trifluoromethylphenyl, phenyl which is trisubstituted by halogen, $C_1$–$C_4$-alkoxy and phenoxy, such as 2-fluoro-4-ethoxy-3-phenoxyphenyl, phenyl which is trisubstituted by halogen, $C_1$–$C_4$-haloalkyl and phenoxy, such as 4-fluoro-3-trifluoromethyl-2-phenoxyphenyl, phenyl which is trisubstituted by $C_1$–$C_4$-alkyl, $C_1$–$C_4$-alkoxy and $C_1$–$C_4$-haloalkyl, such as 4-methyl-3-methoxy-2-trichloromethylphenyl, phenyl which is trisubstituted by $C_1$–$C_4$-alkyl, $C_1$–$C_4$-alkoxy and phenoxy, such as 4-methyl-3-ethoxy-2-phenoxyphenyl, phenyl which is trisubstituted by $C_1$–$C_4$-alkyl, $C_1$–$C_4$-haloalkyl and phenoxy, such as 2-methyl-4-trifluoromethyl-3-phenoxyphenyl, phenyl which is trisubstituted by $C_1$–$C_4$-alkoxy, $C_1$–$C_4$-haloalkyl and phenoxy, such as 4-methoxy-2-trichloromethyl-3-phenoxyphenyl, $R^1$ and $R^2$ or $R^2$ and $R^3$ together $(CH_2)_n$, such as $CH_2$, $(CH_2)_2$, $(CH_2)_3$, $(CH_2)_4$, $(CH_2)_5$ and $(CH_2)_6$, preferably $(CH_2)_3$, $(CH_2)_4$, $(CH_2)_5$, $(CH_2)_6$, particularly preferably $(CH_2)_3$ and $(CH_2)_4$, $(CH{=}CH)_m$, such as $(CH{=}CH)$, $(CH{=}CH)_2$, $(CH{=}CH)_3$, preferably $(CH{=}CH)_2$, $(CH{=}CH)_3$, particularly preferably $(CH{=}CH)_2$, n 1 to 6, preferably 3 to 6, particularly preferably 3 and 4, m 1 to 3, preferably 2 and 3, particularly preferably 2.

$R^{3'}$ hydrogen unbranched or branched $C_1$–$C_{20}$-alkyl, preferably $C_1$–$C_{12}$-alkyl such as methyl, ethyl, n-propyl, iso-propyl, n-butyl, iso-butyl, sec-butyl, tert-butyl, n-pentyl, iso-pentyl, sec-pentyl, tert-pentyl, neo-pentyl, 1,2-dimethylpropyl, n-hexyl, iso-hexyl, sec-hexyl, n-heptyl, iso-heptyl, n-octyl, n-nonyl, iso-nonyl, n-decyl, iso-decyl, n-undecyl, iso-undecyl, n-dodecyl and iso-dodecyl, particularly preferably unbranched or branched $C_1$–$C_8$-alkyl such as methyl, ethyl, n-propyl, iso-propyl, n-butyl, iso-butyl, sec-butyl, tert-butyl, n-pentyl, iso-pentyl, sec-pentyl, tert-pentyl, neo-pentyl, 1,2-dimethylpropyl, n-hexyl, iso-hexyl, sec-hexyl, n-heptyl, iso-heptyl, n-octyl, unbranched or branched $C_2$–$C_{20}$-alkenyl, preferably unbranched or branched $C_2$–$C_8$-alkenyl such as vinyl, allyl, 1-butenyl, 2-butenyl, 3-butenyl, 1-pentenyl, 2-pentenyl, 3-pentenyl, 4-pentenyl, 1-hexenyl, 2-hexenyl, 3-hexenyl and 4-hexenyl, unbranched or branched $C_2$–$C_{20}$-alkynyl, preferably unbranched or branched $C_2$–$C_8$-alkynl such as ethynyl, 1-propyn-3-yl, 1-butyn-3-yl, 1-pentyn-3-yl, 1-hexyn-5-yl, 1-heptyn-6-yl and 1-octyn-7-yl, unbranched or branched $C_2$–$C_{20}$-alkoxyalkyl, preferably unbranched or branched $C_2$–$C_8$-alkoxyalkyl such as methoxymethyl, ethoxymethyl, n-propoxymethyl, iso-propoxymethyl, n-butoxymethyl, iso-butoxymethyl, sec-butoxymethyl, tert-butoxymethyl, n-pentoxymethyl, iso-pentoxymethyl, sec-pentoxymethyl, tert-pentoxymethyl, neo-pentoxymethyl, 1,2-di-methylpropoxymethyl, n-hexoxymethyl, iso-hexoxymethyl, sec-hexoxymethyl, n-heptoxy-methyl, iso-heptoxymethyl, 1-methoxyethyl, 1-ethoxyethyl, 1-n-propoxyethyl, 1-iso-propoxyethyl, 1-n-butoxyethyl, 1-iso-butoxyethyl, 1-sec-butoxyethyl, 1-tert-butoxyethyl, 1-n-pentoxyethyl, 1-iso-pentoxy-ethyl, 1-sec-pentoxyethyl, 1-tert-pentoxy-ethyl, 1-neo-pentoxyethyl, 1-(1,2-dimethylpropoxy)ethyl, 1-n-hexoxyethyl, 1-iso-hexoxy-ethyl, 1-sec-hexoxyethyl, 2-methoxyethyl, 2-ethoxyethyl, 2-n-propoxyethyl, 2-iso-propoxyethyl, 2-n-butoxyethyl, 2-iso-butoxyethyl, 2-sec-butoxyethyl, 2-tert-butoxyethyl, 2-n-pentoxyethyl, 2-iso-pentoxyethyl, 2-sec-pentoxyethyl, 2-tert-pentoxyethyl, 2-neo-pentoxyethyl, 2-(1,2-dimethyl-propoxy)ethyl, 2-n-hexoxyethyl, 2-iso-hexoxyethyl and 2-sec-hexoxyethyl, unbranched or branched $C_4$–$C_{20}$-alkenyloxyalkyl, preferably unbranched or branched $C_4$–$C_8$-alkenyloxyalkyl such as allyloxymethyl, 1-allyloxyethyl, 2-allyloxyethyl, 1-allyloxypropyl and 2-allyloxypropyl, $C_3$–$C_{12}$-cycloalkyl, preferably $C_3$–$C_8$-cycloalkyl such as cyclopropyl, cyclobutyl, cyclopentyl, cyclohexyl, cycloheptyl and cyclooctyl, $C_4$–$C_{20}$-cycloalkylalkyl, preferably $C_4$–$C_8$cycloalkylalkyl such as cyclopentylmethyl, 2-cyclopentylethyl, 1-cyclopentylethyl, cyclohexylmethyl, 1-cyclohexylethyl and 2-cyclohexylethyl, $R^{4'}$ $C_1$–$C_8$-alkyl, preferably unbranched $C_1$–$C_8$-alkyl such as methyl, ethyl, propyl, butyl, n-pentyl, n-hexyl, n-heptyl or n-octyl, particularly preferably unbranched $C_1$–$C_4$-alkyl such as methyl, ethyl, n-propyl or n-butyl, $R^{5'}$, $R^{6'}$, independently of one another $R^{7'}$, $R^{8'}$, $R^{9'}$ hydrogen $C_1$–$C_8$-alkyl, preferably $C_1$–$C_4$-alkyl such as methyl, ethyl, n-propyl, iso-propyl, n-butyl, iso-butyl, sec-butyl or tert-butyl, particularly preferably methyl or ethyl, $C_1$–$C_8$-alkoxy, preferably $C_1$–$C_4$-alkoxy such as methoxy, ethoxy, n-propoxy, iso-propoxy, n-butoxy, iso-butoxy, sec-butoxy or tert-butoxy, particularly preferably methoxy or ethoxy, $C_2$–$C_8$-alkenyl, preferably $C_2$–$C_4$-alkenyl such as vinyl, allyl, 3-butenyl, 2-butenyl and 1-butenyl, $C_3$–$C_8$-alkenyloxy, preferably $C_3$–$C_6$-alkenyloxy such as allyloxy, 1-butenyloxy, 2-butenyloxy, 3-butenyloxy, 1-pentenyloxy, 2-pentenyloxy, 3-pentenyloxy or 4-pentenyloxy, 1-hexenyloxy and 2-hexenyloxy, $C_2$–$C_8$-alkynyl, preferably $C_2$–$C_4$-alkynyl such as ethynyl, 2-propynyl and 3-butynyl, $C_3$–$C_8$-alkynyloxy, preferably $C_3$–$C_4$-alkynyloxy such as propynyloxy and butynyloxy, halogen such as fluorine, chlorine, bromine or iodine, preferably fluorine, chlorine and bromine, cyano, phenyl, phenoxy, halophenyl, preferably chlorophenyl such as 2-chlorophenyl and 4-chlorophenyl, halophenoxy, preferably chlorophenoxy such as 2-chlorophenoxy and 4-chlorophenoxy, carboxyl, $C_2$–$C_8$-alkoxycarbonyl, preferably $C_2$–$C_4$-alkoxycarbonyl such as methoxycarbonyl, ethoxycarbonyl, propoxycarbonyl, isopropoxycarbonyl, n-butoxycarbonyl, isobutoxycarbonyl and tert-butoxycarbonyl, $C_3$–$C_8$-alkenyloxycarbonyl, preferably $C_3$–$C_6$-alkenyloxycarbonyl such as allyloxycarbonyl, 1-butenyloxycarbonyl, 1-pentenyloxycarbonyl and 1-hexenyloxycarbonyl, $C_3$–$C_8$-alkynyloxycarbonyl, preferably $C_3$–$C_5$-alkynyloxycarbonyl such as propynyloxycarbonyl and butynyloxycarbonyl, $R^{5'}$, and $R^{6'}$ or $R^{6'}$ and $R^{7'}$ together $(CH_2)_n$, such as $CH_2$, $(CH_2)_2$, $(CH_2)_3$, $(CH_2)_4$, $(CH_2)_5$ and $(CH_2)_6$, preferably $(CH_2)_3$, $(CH_2)_4$, $(CH_2)_5$, $(CH_2)_6$, particularly preferably $(CH_2)_3$ and $(CH_2)_4$, $(CH{=}CH)_m$, such as $(CH{=}CH)$, $(CH{=}CH)_2$, $(CH{=}CH)_3$, preferably $(CH{=}CH)_2$, $(CH{=}CH)_3$, particularly preferably $(CH{=}CH)_2$, n 1 to 10, preferably 3 to 6, particularly preferably 3 and 4, m 1 to 3, preferably 2 and 3, particularly preferably 2.

All of $R^{5'}$ to $R^{9'}$ can be other than hydrogen, preferably 0 to 3 are other than hydrogen and particularly preferably 0 to 2 are other than hydrogen.

Mono- to trisubstituted means substituted once, twice or three times.

In order to ensure adequate conductivity of the electrolyte for the electrolysis, an auxiliary electrolyte, which preferably contains halogen, is added to the electrolysis mixture. Examples of suitable auxiliary electrolytes are elemental halogen, alkyl halide and hydrogen halide, and iodides or bromides are preferably employed, such as ammonium halides, e.g. ammonium bromide, ammonium iodide and tetrabutylammonium iodide and particularly preferably metal halides such as sodium bromide, sodium iodide, potassium iodide and potassium bromide.

The composition of the electrolyte can vary within wide limits. The electrolyte generally contains from 0 to 5% by weight of water. The electrolytes can have the following compositions, for example:

1 to 49, preferably 5 to 30% by weight of ketone of the formula II 50 to 98.8, preferably 70 to 95% by weight of alkanol $R^2$—OH 0.1 to 5, preferably 0.5 to 3% by weight of auxiliary electrolyte and 0.1 to 5, preferably 0.5 to 3% by weight of water.

The electrochemical oxidation is preferably carried out at current densities of from 0.5 to 25 $A/dm^2$ and at from −20° to 60° C., in particular 0° to 40° C. Higher temperatures are possible but generally have no advantages. The reaction can be carried out under subatmospheric or superatmospheric pressure, but preferably under atmospheric pressure, in conventional electrolysis cells. Undivided continuous flow cells are preferably employed.

Examples of suitable anode materials are noble metals such as platinum or oxides such as ruthenium and chromium oxide or $RuO_xTiO_x$ mixed oxides and, preferably, graphite.

Usually suitable as cathode materials are iron, steel, nickel and noble metals such as platinum and, preferably, graphite.

Working up is carried out in a conventional manner, and the compounds I according to the invention are preferably worked up by distillation.

Preferred compounds I are tabulated hereinafter:

| $R^1$ | $R^2$ | $R^3$ | $R^4$ |
|---|---|---|---|
| methyl | 4-methoxyphenyl | H | methyl |
| methyl | 2-methoxyphenyl | H | methyl |
| 2-methoxyphenyl | methyl | H | methyl |
| phenyl | propyl | H | methyl |
| methyl | 2-fluorophenyl | H | methyl |
| methyl | 2-methyl-2-butenyl | H | methyl |
| 2,5-dimethyl-2-hexenyl | H | H | methyl |
| dimethoxymethyl | H | H | methyl |
| tert-butyl | H | H | methyl |
| tert-butyl | 4-fluorophenyl | H | methyl |
| methyl | 4-fluorophenyl | H | methyl |

Hydroxymethyl aryl acetals I are valuable precursors for hydroxyphenones and can be converted into crop protection agents, photoinitiators, scents and pharmaceutical products.

EXAMPLES 1 TO 8

The starting compounds II were subjected to an electrolysis in an undivided cell with 11 bipolar electrodes in an electrolyte which contained 45 g of potassium iodide as auxiliary electrolyte. The anode and cathode were composed of graphite. The current density was 3.3 A/dm$^2$ and the electrolysis was carried out at 25° C. The electrolyte was pumped at a rate of 200 l/ h through the cell. The exact composition of the electroyte as well as further details of Examples 1 to 4 and Experiments 5 to 8 which were carried out for comparison without added water are compiled in Table A.

TABLE A

| Example No. | Compound II/amount [g] | Methanol/ amount [g] | Water/ amount [g] | Amount of charge [F/mol] | Yield [%] | Selectivity [%] |
|---|---|---|---|---|---|---|
| 1 | cyclohexanone/450 | 2490 | 15 | 2.4 | 83 | |
| 2 | 3,3-dimethyl-2-butanone/150 | 2292.5 | 12.5 | 4 | 45 | |
| 3 | 4-fluorophenylacetaldehyde/300 | 2640 | 15 | 2.5 | 48 | |
| 4 | propiophenone/300 | 2565 | 90 | 3 | 48 | 52 |
| Experiments without added water | | | | | | |
| 5 | cyclohexanone/450 | 2505 | — | 2 | 57 | |
| 6 | 3,3-dimethyl-2-butanone/160 | 2295 | — | 4 | 34 | |
| 7 | 4-fluorophenylacetaldehyde/300 | 2655 | — | 2.5 | 41.5 | |
| 8 | propiophenone/450 | 2505 | — | 3 | 28 | 30 |

EXAMPLES 9 TO 13

Starting compounds II' were subjected to an electrolysis in an undivided cell with 11 bipolar electrodes in an electrolyte which contained 45 g of potassium iodide as auxiliary electrolyte. The anode and cathode were composed of graphite. The current density was 3.3 A/dm$^2$ and the electrolysis was carried out at 25° C. The electrolyte was pumped at a rate of 200 l/h through the cell. The exact composition of the electrolyte and further details of the examples are compiled in Table B:

TABLE B

| Example No. | Compound II'/amount [g] | Alkanol/ amount [g] | Water content [g] | Amount of charge [F/mol] | Yield [%] | Selectivity [%] |
|---|---|---|---|---|---|---|
| 9 | propiophenone/300 | MeOH/2565 | 90 | 3 | 48 | 52 |
| 10 | butyrophenone/450 | MeOH/2505 | — | 4.5 | 68 | 72 |
| 11 | valerophenone/450 | MeOH/2505 | — | 3 | 30 | 37 |
| 12 | p-methoxypropiophenone/300 | MeOH/2640 | 15 | 10 | 55 | 56 |
| 13 | p-methylpropiophenone/250 | MeOH/2690 | 15 | 3.5 | 53 | 53 |

We claim:

1. A process for preparing an α-hydroxymethyl acetal of the formula I

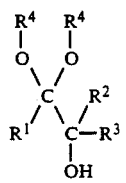

(I)

where $R^1$, $R^2$ and $R^3$ are each, independently of one another, hydrogen, $C_1$–$C_{20}$-alkyl, $C_2$–$C_{20}$-alkenyl, $C_2$–$C_{20}$alkynyl, $C_3$–$C_{12}$-cycloalkyl, $C_4$–$C_{20}$-cycloalkylalkyl, $C_1$–$C_{20}$-hydroxyalkyl, aryl or $C_7$–$C_{20}$-arylalkyl which is unsubstituted or substituted by $C_1$–$C_8$-alkyl, $C_1$–$C_8$-alkoxy, halogen, $C_1$–$C_4$-haloalkyl, $C_1$–$C_4$-haloalkoxy, phenyl, phenoxy, halophenyl, halophenoxy, carboxyl, $C_2$–$C_8$-alkoxycarbonyl or cyano, or $R^1$ and $R^2$ or $R^2$ and $R^3$ together are $(CH_2)_n$ or $(CH{=}CH)_m$ which is unsubstituted or mono- or disubstituted by $C_1$–$C_8$-alkyl, C–$C_8$-alkoxy and/or halogen and in which n is 1 to 10 and m is 1 to 3 and $R^4$ is $C_1$–$C_8$-alkyl, which comprises electrochemical oxidation of a carbonyl compound of the formula II

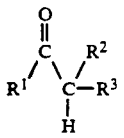

(II)

where $R^1$, $R^2$ and $R^3$ have the abovementioned meanings, with an alkanol of the formula III $$R^4—OH \quad (III)$$

where $R^4$ has the abovementioned meaning under non-alkaline conditions in the presence of an auxiliary electrolyte and from 0 to 5% by weight of water.

2. A process for preparing an α-hydroxymethyl aryl acetal of the formula I'

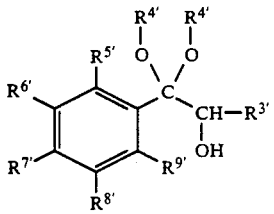

(I')

where $R^{3'}$ is hydrogen, $C_1$–$C_{20}$-alkyl, $C_2$–$C_{20}$-alkenyl, $C_2$–$C_{20}$-alkynl, $C_2$–$C_{20}$-alkoxyalkyl, $C_4$–$C_{20}$-alkenyloxyalkyl, $C_3$–$C_{12}$-cycloalkyl or $C_4$–$C_{20}$-cycloalkylalkyl, $R^{4'}$ is $C_1$–$C_8$-alkyl and $R^{5'}$, $R^{6'}$, and $R^{7'}$, $R^{8'}$ and $R^{9'}$ are each, independently of one another, hydrogen, $C_1$–$C_8$-alkyl, $C_1$–$C_8$-alkoxy, $C_2$–$C_8$-alkenyl, $C_3$–$C_8$-alkenyloxy, $C_2$–$C_8$-alkynyl, $C_3$–$C_8$-alkynyloxy, halogen, cyano, phenyl, phenoxy, halophenyl, halophenoxy, carboxyl, $C_2$–$C_8$-alkoxycarbonyl, $C_3$–$C_8$-alkenyloxycarbonyl, $C_3$–$C_8$-alkynyloxycarbonyl, or $R^{5'}$ and $R^{6'}$ or $R^{6'}$ and $R^{7'}$ together are $(CH_2)_{n'}$ or $(CH{=}CH)_{m'}$ which is unsubstituted or mono- or disubstituted by $C_1$–$C_8$-alkyl, $C_1$–$C_8$-alkoxy and/or halogen and in which n' is 1 to 10 and m, is 1 to 3, which comprises electrochemical oxidation of an aryl methyl ketone of the formula II'

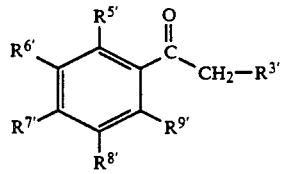

(II')

where $R^{3'}$ has the abovementioned meanings, with an alkanol of the formula III'

$$R^{4'}—OH \quad (III')$$

where $R^{4'}$ has the abovementioned meanings, under non-alkaline conditions in the presence of an auxiliary electrolyte and from 0 to 5% by weight of water.

3. A process as claimed in claim 2, wherein the reaction is carried out in the presence of an auxiliary electrolyte and from 0.1 to 5% by weight of water.

4. A process as claimed in claim 1, wherein an electrolyte of the composition 1 to 49% by weight of carbonyl compound of the formula II, 50 to 98.9 % by weight of an alkanol of the formula III, 0.1 to 5% by weight of an auxiliary electrolyte and 0.1 to 5% by weight of water is used for the electrochemical oxidation.

5. A process as claimed in claim 1, wherein the electrochemical oxidation is carried out on graphite electrodes.

6. A process as claimed in claim 1, wherein the electrochemical oxidation is carried out at from −20° to 60° C. and at current densities of 0.5 to 25 A/dm$^2$.

7. A process as claimed in claim 1, wherein iodides or bromides are employed as auxiliary electrolyte.

8. A process as claimed in claim 3, wherein the amount of water added to the electrolyte is from 0.5 to 3% by weight.

9. A process as claimed in claim 4, wherein the amount of water added to the electrolyte is from 0.5 to 3% by weight.

10. A process as claimed in claim 1, wherein the auxiliary electrolyte is selected from the group consisting of elemental halogen, hydrogen halides, alkyl halides, ammonium halides and metal halides.

11. A process as claimed in claim 1, wherein the auxiliary electrolyte is selected from the group consisting of lithium, sodium and potassium halides.

12. A process as claimed in claim 1, wherein the auxiliary electrolyte is selected from the group consisting of sodium bromide, sodium iodide, potassium bromide and potassium iodide.

* * * * *